US010010160B1

(12) United States Patent
Ostrowski et al.

(10) Patent No.: US 10,010,160 B1
(45) Date of Patent: Jul. 3, 2018

(54) LOAD-SUPPORTING GARMENT

(71) Applicant: MOLLOTEC LLC, Philadelphia, PA (US)

(72) Inventors: Tara Victoria Ostrowski, Philadelphia, PA (US); Jeffrey Michael Archer, Philadelphia, PA (US)

(73) Assignee: MOLLOTEK LLC, Philadelphia, PA (US)

( * ) Notice: Subject to any disclaimer, the term of this patent is extended or adjusted under 35 U.S.C. 154(b) by 0 days.

(21) Appl. No.: 15/656,677

(22) Filed: Jul. 21, 2017

(51) Int. Cl.

| | |
|---|---|
| ***A45F 5/02*** | (2006.01) |
| ***A41D 1/04*** | (2006.01) |
| ***A45F 3/14*** | (2006.01) |
| ***A41D 1/00*** | (2018.01) |
| ***A41D 27/20*** | (2006.01) |
| *A41D 13/00* | (2006.01) |

(52) U.S. Cl.
CPC ..... *A45F 3/14* (2013.01); *A41D 1/002* (2013.01); *A41D 1/04* (2013.01); *A41D 27/205* (2013.01); *A41D 13/0012* (2013.01); *A41D 2300/322* (2013.01); *A41D 2500/20* (2013.01); *A45F 5/02* (2013.01); *A45F 2003/146* (2013.01)

(58) Field of Classification Search
CPC .... A45F 5/02; A45F 3/06; A41D 1/00; A41D 1/04; A41D 13/00
See application file for complete search history.

(56) References Cited

U.S. PATENT DOCUMENTS

| | | | | |
|---|---|---|---|---|
| 4,539,700 A | | 9/1985 | Masanobu et al. | |
| 5,007,412 A | | 4/1991 | DeWall et al. | |
| 5,724,707 A | | 3/1998 | Kirk et al. | |
| 6,962,277 B2 * | | 11/2005 | Quintana | A45F 3/14 224/262 |
| 7,200,871 B1 | | 4/2007 | Carlson et al. | |
| 8,209,769 B1 * | | 7/2012 | Ellis | F41C 33/00 2/2.5 |
| 8,365,312 B2 * | | 2/2013 | Herring | A41D 13/0007 2/102 |

(Continued)

FOREIGN PATENT DOCUMENTS

| | | |
|---|---|---|
| EP | 2476327 A2 | 7/2012 |

OTHER PUBLICATIONS

Lowepro Street & Field Series—Professional modular equipment, http://www.lowepro.com/sfseries @2017, accessed Apr. 4, 2017, 5 pages.

(Continued)

*Primary Examiner* — Justin Larson

(74) *Attorney, Agent, or Firm* — Condo Roccia Koptiw LLP

(57) ABSTRACT

The disclosed load-supporting garment is a safer and more effective way to carry equipment. For example, the system enables a more even distribution of gear and its accompanying weight around the body. An example load-supporting garment may include a plurality of woven grid panels, with two or more front panels and two or more rear panels, and a back boning panel attached to the two or more rear panels. Each of the plurality of woven grid panels may include a plurality of horizontal fabric bands that are perpendicular to a plurality of vertical fabric bands. The plurality of horizontal and vertical fabric bands may alternatingly overlap. This may define a woven grid.

12 Claims, 4 Drawing Sheets

(56) References Cited

U.S. PATENT DOCUMENTS 8,490,212 B1 * 7/2013 Asher ..... A41D 1/04 2/2.5
8,572,762 B2 * 11/2013 Herbener ..... F41H 1/02 2/2.5
8,595,862 B2 * 12/2013 Storms, Jr. ..... A41D 13/05 2/102
8,608,041 B1 * 12/2013 Adkisson ..... A45F 5/00 2/102
8,826,462 B2 * 9/2014 Storms, Jr. ..... A41D 1/04 2/102
8,827,940 B2 * 9/2014 Anquetil ..... A61F 5/028 2/255
8,898,814 B2 * 12/2014 Storms, Jr. ..... A41D 1/04 2/102
8,990,971 B2 * 3/2015 Carter ..... A45F 3/10 2/2.5
8,997,262 B2 * 4/2015 Klein ..... A45F 3/06 2/108
9,055,773 B2 * 6/2015 Crye ..... A41D 13/0007
9,144,294 B2 * 9/2015 Gregory ..... A41D 13/0012
9,173,436 B2 11/2015 Crye et al.
9,486,058 B1 * 11/2016 Moreau ..... A45F 3/00
9,521,897 B2 * 12/2016 Thompson ..... A45F 5/02
9,603,393 B2 * 3/2017 Crye ..... A41D 13/0007
9,854,897 B1 * 1/2018 Pelkey, Jr. ..... A45F 3/04
2009/0039122 A1 * 2/2009 Antonioni ..... A45C 13/02 224/250
2011/0191933 A1 * 8/2011 Gregory ..... A41D 13/0012 2/69
2012/0180184 A1 7/2012 Crye et al.
2013/0193179 A1 * 8/2013 Davidson ..... A45F 5/00 224/585
2013/0198928 A1 * 8/2013 Asher ..... A41D 1/04 2/102
2013/0292430 A1 * 11/2013 Seuk ..... A45F 3/20 224/148.4
2013/0312149 A1 * 11/2013 Asher ..... F41H 1/02 2/2.5
2014/0090145 A1 * 4/2014 Strum ..... F41H 1/02 2/69
2014/0151424 A1 * 6/2014 Hexels ..... A45F 3/06 224/637
2014/0201879 A1 * 7/2014 Seuk ..... F41H 1/02 2/2.5
2014/0361058 A1 * 12/2014 Gill ..... A45F 3/04 224/259
2015/0059051 A1 * 3/2015 Storms, Jr. ..... A41D 1/04 2/102
2015/0366273 A1 12/2015 Rudick et al.
2015/0374106 A1 * 12/2015 Gleason ..... A45F 3/047 224/264
2016/0022017 A1 * 1/2016 Ben Lulu ..... A45F 3/08 224/259
2016/0040958 A1 * 2/2016 Alcantra ..... A41D 3/00 224/182
2016/0143425 A1 * 5/2016 Tvrdy ..... A45F 5/02 24/3.12
2016/0367021 A1 * 12/2016 Moreau ..... A45F 3/00
2017/0307335 A1 * 10/2017 Skifstad ..... A45F 3/06
2017/0320286 A1 * 11/2017 Carlson ..... B32B 3/266
2017/0343320 A1 * 11/2017 Storms ..... F41H 1/02

OTHER PUBLICATIONS

Portabrace: Professional Camera Cases and Covers http://www.portabrace.com/audio-vests.html/@2015, accessed Apr. 4, 2017, 3 pages.

* cited by examiner

LOAD-SUPPORTING GARMENT

BACKGROUND

Many occupations require carrying and operating various equipment. For example, sound recordists in the television and motion picture industry often carry thirty pounds of equipment to perform their jobs, typically using a bag that rests on one's abdomen and connects to a harness over one's shoulders. This additional frontal weight compromises the recordist's center of gravity and over time may give rise to sciatic nerve pain and back pain issues.

SUMMARY

The disclosed load-supporting garment is a safer and more effective way to carry equipment. For example, the system enables a more even distribution of gear and its accompanying weight around the body.

An example load-supporting garment may include a plurality of woven grid panels, with two or more front panels and two or more rear panels, and a back boning panel attached to the two or more rear panels.

Each of the plurality of woven grid panels may include a plurality of horizontal fabric bands that are perpendicular to a plurality of vertical fabric bands. The plurality of horizontal and vertical fabric bands may alternatingly overlap. This may define a woven grid. The plurality of horizontal and vertical fabric bands may be spaced such that the woven grid defines a plurality of openings in between the plurality of horizontal and vertical fabric bands. And each of the plurality of horizontal and vertical fabric bands may be attached at a perimeter of a respective woven grid panel.

The back boning panel may include a back boning encased within a fabric housing. The back boning and the fabric housing may extend from a top edge of the back boning panel to a bottom edge of the back boning panel.

DETAILED DESCRIPTION

Figure 1B:
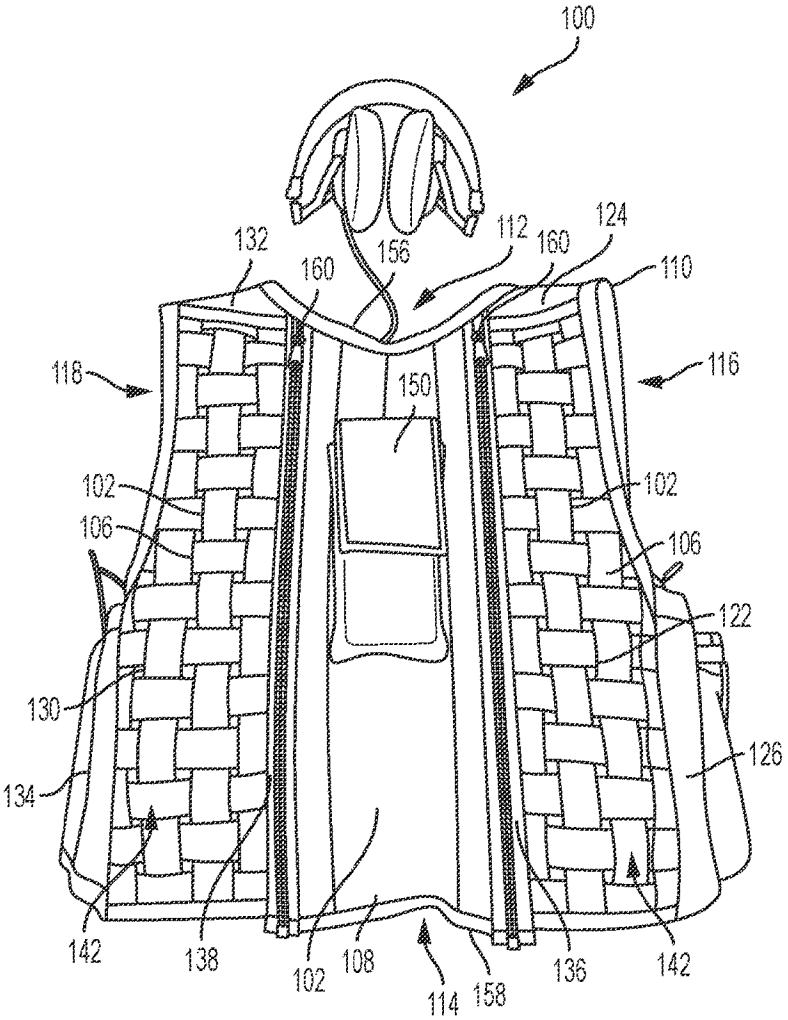
FIGS. 1A-b depict front and rear views of an example load supporting garment.
Figure 1A:
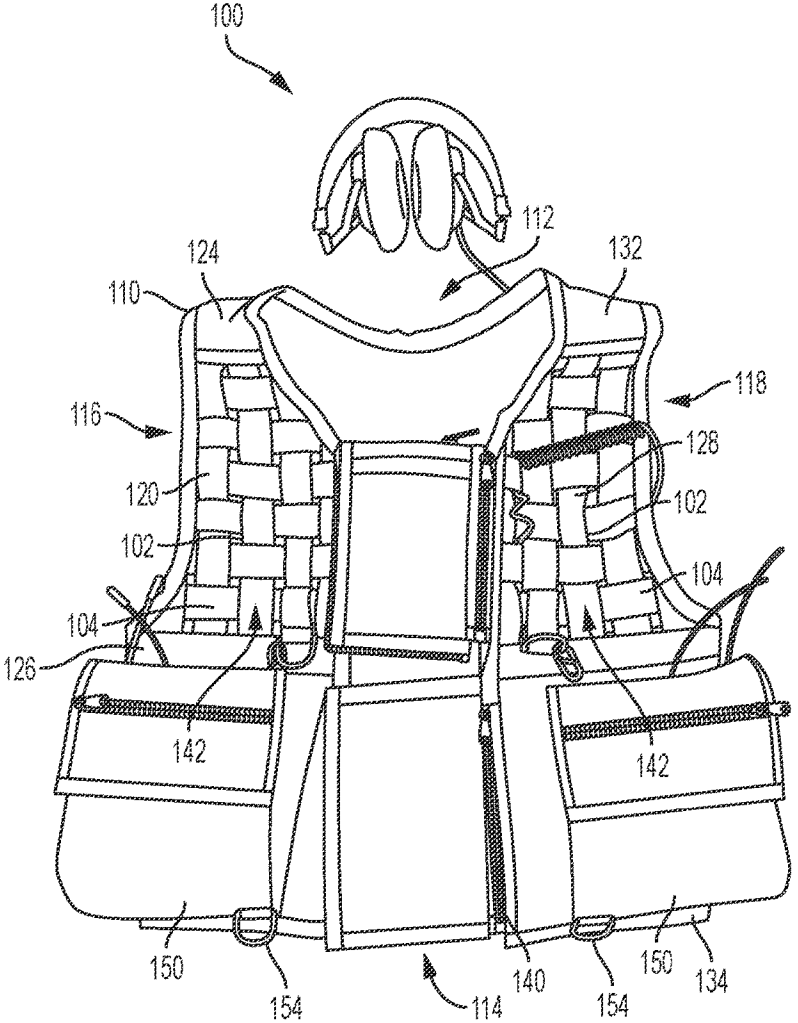

FIGS. 1A-b depict front and rear views, respectively, of an example load supporting garment 100. The load supporting garment 100 includes a one or more panels 102. The panels 102 may be formed as one or more front panels 104, one or more rear panels 106, and one or more back boning panels 108. The panels 102 may be joined together at certain edges to form a vest body 110 of the load supporting garment 100. For example, the panels 102 may be configured to be connected to define a vest body 110 with a neck opening 112, a waist opening 114, and two arm openings 116, 118.

A first front panel 120 and a first rear panel 122 may be joined together at corresponding top portion 124 and side portion 126. This assembly of panels 102 may define an arm opening 116 in the vest body 110 of the load supporting garment 100. A second front panel 128 and a second rear panel 130 may be joined together at corresponding top portion 132 and side portion 134. This assembly of panels 102 may define an arm opening 118 in the vest body 110 of the load supporting garment 100.

The first rear panel 122 may be joined on a first long edge 136 to the back boning panel 108. The first long edge 136 may be opposite the corresponding side portion 126. The first long edge 136 may be adjacent to the corresponding top portion 124. The second rear panel 130 may be joined on a second long edge 138 to the back boning panel 108. The second long edge 138 may be opposite the corresponding side portion 134. The second long edge 138 may be adjacent to the corresponding top portion 132. Such an assembly may form a back portion of the vest body 110.

The front panels 120 may be suitable for temporarily connecting and disconnecting via one or more fasteners 140. This structure may enable the opening and closing of the vest body 110. The fasteners 140 may be any fastener suitable for a load supporting garment 100. For example, the fasteners 140 may include eyelets and buttons, snap buttons, zippers, hooks and loops panels and the like. When closed with the fasteners 140 the joining of the front panels 104, rear panels 106, and back boning panel 108, as described above, may define the neck opening 112 in the vest body 110. When closed with the fasteners 140 the joining of the front panels 104, rear panels 106, and back boning panel 108, as described above, may define the waist opening 114 in the vest body 110.

As will be discussed more in context with FIGS. 2 and 3, one or more of the panels may be formed as a woven grid panel 142. For example, one or more of the front panels 104 may be woven grid panels 142. For example, one or more of the rear panels 106 may be woven grid panels 142. A woven grid panel 142 may include a plurality of horizontal fabric bands 144 and/or a plurality of vertical fabric bands 146. The bands may alternatingly overlap to define a woven grid. The plurality of horizontal fabric bands 144 and vertical fabric bands 146 may be spaced such that the woven grid defines a plurality of openings 148 in between the plurality of horizontal fabric bands 144 and vertical fabric bands 146. For example, the plurality of horizontal fabric bands 144 and vertical fabric bands 146 may be spaced such that the woven grid defines a plurality of openings 148 defined by open space between adjacent horizontal fabric bands 144 and adjacent vertical fabric bands 146 when viewed orthogonal to a face of the woven grid. Each of the plurality of horizontal fabric bands 144 and vertical fabric bands 146 may be attached at a perimeter 150 of a respective woven grid panel 142.

Each of the plurality of woven grid panels 142 may include a mesh inner lining (not shown) adjacent to an internal surface of the woven grid. The mesh inner lining may be made of any suitable fabric(s) or material(s), for example a fabric that providing a barrier between the body any technical wires and grid. The fabric may also allow air to travel through the fabric making it breathable. For example, the mesh inner lining may be made of Coolmax® fabric.

The load supporting garment 100 may be configured to hold and/or store one more pieces of equipment and or wires. For example, the load-supporting garment 100 may include one or more pockets 152. For example, the load-supporting garment 100 may include a pallet base 154 that is configured to connect one or more of a pocket 152 and/or any other storage arrangement to the load supporting garment 100. Also for example, one or more pockets 152 may be joined to the vest body 110. For example, the pockets 152 may be sewn to the vest body 110. The pockets 152 may be attached via hooks and loops to the pallet base 154 of the vest body 110. The pocket or pockets 152 may have an orifice configured to accept a wire associated with equipment held within the pocket 152. For example, one or more pockets 152 may be disposed on one or more of the front panels 104, for example at the bottom portion of one or more of the front panels 104. Also for example, one or more pocket 152 may be disposed on one or more of the rear panels 106. Also for example, one or more pockets 152 may be disposed on the back boning panel 108.

The woven grid may be configured to support one or more items attached to one or more of the horizontal fabric bands 144 or vertical fabric bands 146. For example, convenient fasteners such as clips, loops, and hooks and loops may be used to attach one or more items to one or more of the horizontal fabric bands 144 or vertical fabric bands 146. Also, for example, the plurality of openings 148 in any of the woven grids of the vest body 110 may be configured to receive one or more cables or wires. These cables or wires may be associated with the one or more items supported by the woven grid.

To illustrate, for a typical sound recordist in the television and motion picture industry, the load supporting garment might hold one or more of the following: A multi-track mixer/recorder, one or more wireless receivers and transmitters, high capacity lithium batteries, microphones, headphones, media credentials, tape, small tool kit, recording media, pen and marker, daily assignment instructions. While being held by the load supporting garment, the electronics may be connected to a battery distribution system. Power and/or audio wiring may run from any point on the vest via the open weave.

Figure 2B:
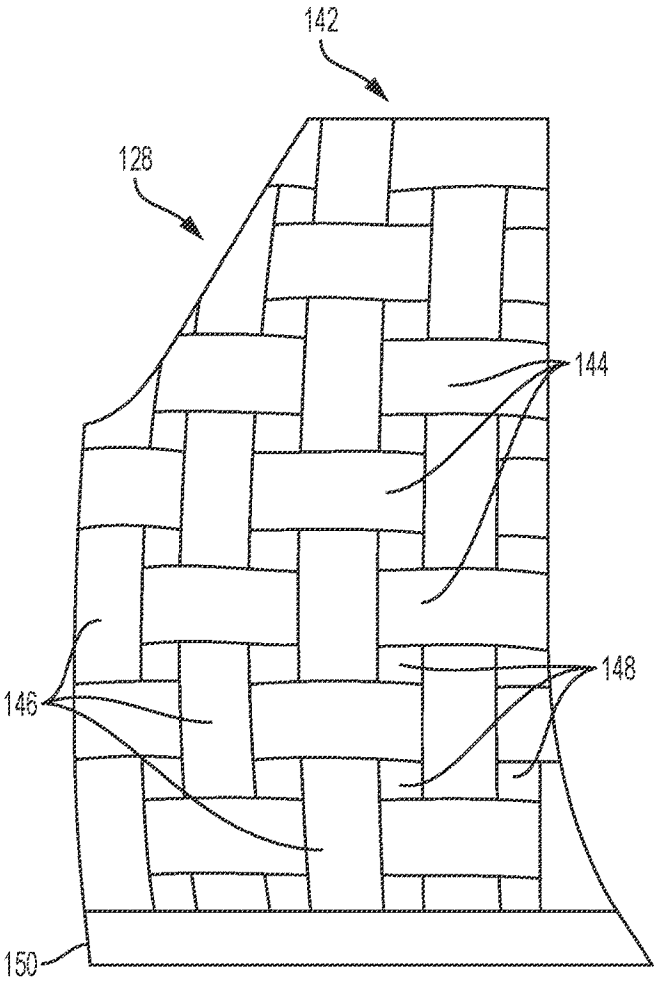
FIGS. 2A-B depict example front woven grid panels, left and right respectively.
Figure 2A:
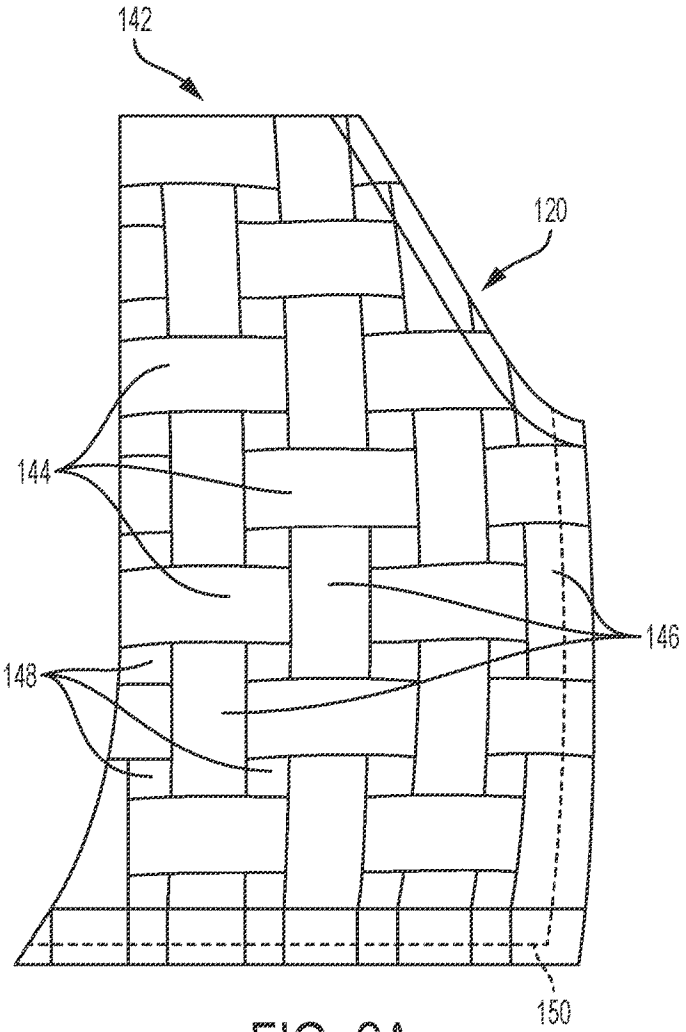
Figure 3B:
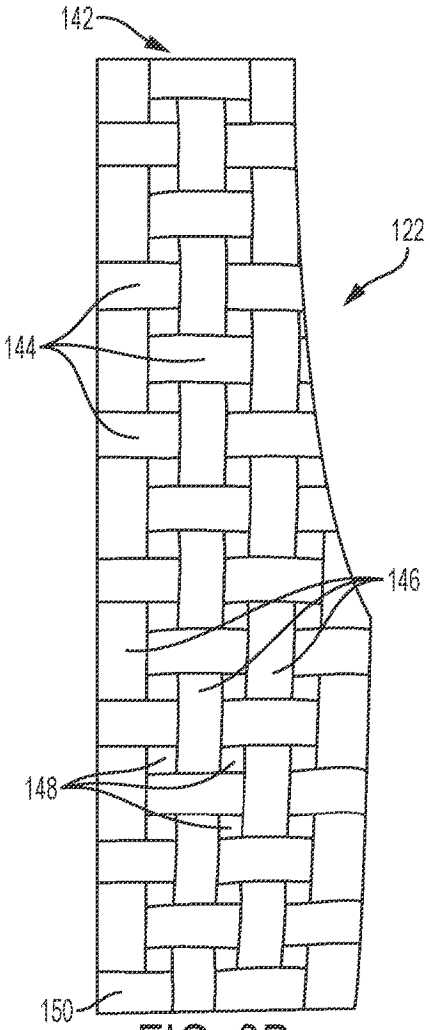
FIGS. 3A-B depict example rear woven grid panels, left and right respectively.
Figure 3A:
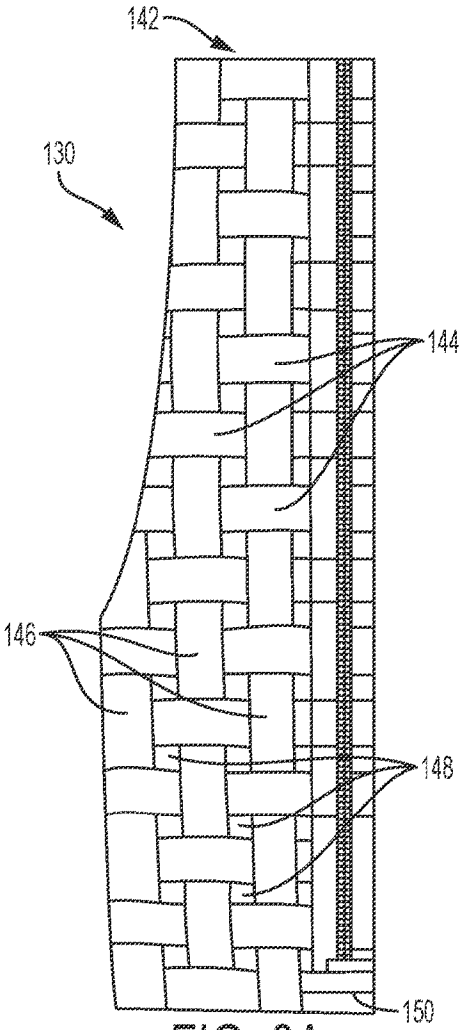

FIGS. 2A-B depict example front woven grid panels, for example a first front panel 120 and a second front panel 128 respectively. And, FIGS. 3A-B depict example rear woven grid panels, for example a second rear panel 130 and a first rear panel 122 respectively.

Each panel 102 may include a plurality of horizontal fabric bands 144 and/or a plurality of vertical fabric bands 146. The bands 144, 146 may alternatingly overlap to define a woven grid. Each of the plurality of horizontal fabric bands 144 and vertical fabric bands 146 may be attached at a perimeter 150 of a respective woven grid panel. The plurality of horizontal fabric bands 144 and vertical fabric bands 146 may be made from Denier Nylon fabric. The plurality of horizontal fabric bands 144 and vertical fabric bands 146 may have a width. The width may be uniform or not uniform. For example, each of the plurality of horizontal and vertical fabric bands may have a width of one inch. Each one-inch wide band may be made from a fabric with a width of four inches; for example, it may be folded over itself to form a fabric band with a width of one inch.

The plurality of horizontal fabric bands 144 and vertical fabric bands 146 may be spaced such that the woven grid defines a plurality of openings 148 in between the plurality of horizontal fabric bands 144 and vertical fabric bands 146. For example, the plurality of horizontal fabric bands 144 and vertical fabric bands 146 may be spaced such that the woven grid defines a plurality of openings 148 defined by open space between adjacent horizontal and adjacent vertical fabric bands when viewed orthogonal to a face of the woven grid. The plurality of openings 148 may be approximately one half inch by one half inch.

Figure 4:
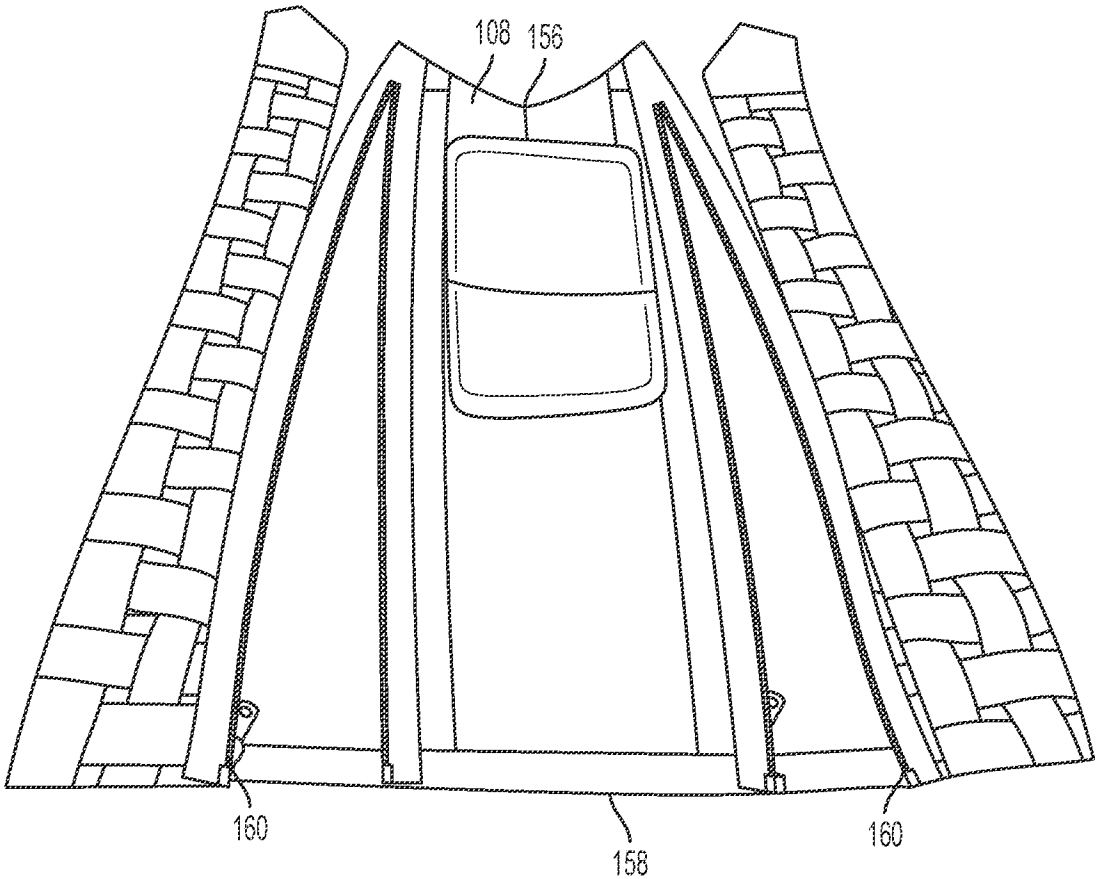
FIG. 4 depicts an example back boning panel.

FIG. 4 depicts an example back boning panel 108. The back boning panel 108 may be configured together with the plurality of woven grid panels 142 a vest body 110 with a neck opening 112, a waist opening 114, and two arm openings 116, 118. The back boning panel 108 may be attached to two or more rear panels 106. The back boning panel may 108 include a back boning encased within a fabric housing. The back boning and the fabric housing may extend from a top edge 156 of the back boning panel 108 to a bottom edge 158 of the back boning panel 108. The fabric housing that encases the back boning may be attached to an external surface of the back boning panel.

The back boning may be made of any material suitable for proving stability, support, and/or flexibility to user and his/her physical body movements. For example, the back boning may be metal or plastic. For example, the back boning may be made of ⅜ inch flexible carbon steel, ⅜ in durable carbon steel, ⅜ inch plastic, or the like.

The back boning panel 108 may include one or more zippers 160. The zippers may be configured to expand a width of the back boning panel.

The invention claimed is:

1. A load-supporting garment comprising:

a plurality of woven grid panels, each of the plurality of woven grid panels comprising a plurality of horizontal fabric bands that are perpendicular to a plurality of vertical fabric bands, wherein the plurality of horizontal and vertical fabric bands alternatingly overlap to define a woven grid, and wherein the plurality of horizontal and vertical fabric bands are spaced such that the woven grid defines a plurality of openings in between the plurality of horizontal and vertical fabric bands, and wherein each of the plurality of horizontal and vertical fabric bands are attached at a perimeter of a respective woven grid panel of the plurality of woven grid panels, and wherein the plurality of woven grid panels include two or more front panels and two or more rear panels; and a back boning panel attached to the two or more rear panels, the back boning panel comprising a metal back boning encased within a fabric housing, wherein the back boning and the fabric housing extends from a top edge of the back boning panel to a bottom edge of the back boning panel.

2. The load-supporting garment of claim 1, wherein each of the plurality of woven grid panels further comprise a mesh inner lining adjacent to an internal surface of the woven grid.

3. The load-supporting garment of claim 1, wherein the fabric housing that encases the back boning is attached to an external surface of the back boning panel.

4. The load-supporting garment of claim 1, wherein the plurality of horizontal and vertical fabric bands are made from Denier Nylon fabric.

5. The load-supporting garment of claim 4, wherein the plurality of horizontal and vertical fabric bands have a width of one inch and are made from a piece of Denier Nylon fabric with a width of four inches.

6. The load-supporting garment of claim 1, wherein the back boning panel further comprises a zipper configured to expand a width of the back boning panel.

7. The load-supporting garment of claim 1, wherein the plurality of woven grid panels and the back boning panel are configured to be connected to define a vest with a neck opening, a waist opening, and two arm openings.

8. The load-supporting garment of claim 1, wherein the woven grid is configured to support one or more items attached to one or more of the horizontal or vertical fabric bands.

9. The load-supporting garment of claim 8, wherein the plurality of openings are configured to receive one or more cables or wires associated with the one or more items supported by the woven grid.

10. The load-supporting garment of claim 1, wherein the plurality of openings are approximately one half inch by one half inch.

11. The load-supporting garment of claim 1, further comprising a pocket having an orifice, wherein the pocket is configured to hold equipment and the orifice is configured to accept a wire associated with the equipment.

12. The load-supporting garment of claim 1, further comprising a pallet base that is configured to connect one or more of a pocket or a bag to the load supporting garment.

* * * * *